US009636832B2

(12) United States Patent
Rexwinkle, Jr. et al.

(10) Patent No.: US 9,636,832 B2
(45) Date of Patent: May 2, 2017

(54) APPARATUS AND METHOD FOR SPIRALLY SLICING MEAT

(75) Inventors: Delbert W. Rexwinkle, Jr., Eastland, MO (US); John L. Ross, Jr., Shawnee, KS (US)

(73) Assignee: SF INVESTMENTS, INC., Wilmington, DE (US)

( * ) Notice: Subject to any disclaimer, the term of this patent is extended or adjusted under 35 U.S.C. 154(b) by 945 days.

(21) Appl. No.: 13/284,107

(22) Filed: Oct. 28, 2011

(65) Prior Publication Data

US 2012/0103149 A1 May 3, 2012

Related U.S. Application Data

(60) Provisional application No. 61/408,323, filed on Oct. 29, 2010.

(51) Int. Cl.
*B26D 3/11* (2006.01)

(52) U.S. Cl.
CPC ..... *B26D 3/11* (2013.01); *Y10T 82/10* (2015.01); *Y10T 83/9413* (2015.04)

(58) Field of Classification Search
CPC . B26D 3/11; Y10T 82/10; Y10T 82/16; Y10T 83/9413
USPC ..... 83/932; 99/537, 538, 593, 594, 596, 597
See application file for complete search history.

(56) References Cited

U.S. PATENT DOCUMENTS

| | | | | | |
|---|---|---|---|---|---|
| 633,932 | A * | 9/1899 | Williamson | ..... | 99/598 |
| 1,458,998 | A * | 6/1923 | Sletto | ..... | 99/592 |
| RE26,684 | E * | 10/1969 | Mason | ..... | 99/592 |
| 4,137,839 | A * | 2/1979 | Couture et al. | ..... | 99/541 |
| 7,428,860 | B2 | 9/2008 | Vagnby | | |
| 8,070,567 | B2 | 12/2011 | Umino et al. | | |
| 2006/0144204 | A1* | 7/2006 | Vagnby | ..... | 83/651.1 |
| 2009/0270021 | A1* | 10/2009 | Umino et al. | ..... | 452/136 |

* cited by examiner

*Primary Examiner* — Stephen Choi
(74) *Attorney, Agent, or Firm* — Hunton & Williams LLP

(57) ABSTRACT

An apparatus and method for spirally slicing meat are disclosed. In one embodiment, a meat stabilizer apparatus includes a paddle; an arm attached to and extending from the paddle; and a coupling assembly that couples the arm to a meat cutting assembly. In another embodiment, a spiral slicing apparatus includes a cutting assembly having a knife blade coupled with a knife carriage; a meat support apparatus having a rotatable turntable coupled with a drive assembly; and a meat stabilizer apparatus having a paddle and an arm attached to and extending from the paddle. In another embodiment, a method for spirally slicing meat includes (1) rotating a meat product about a first axis on a turntable; (2) stabilizing the rotating meat product along its exterior surface with a meat stabilizer apparatus comprising a paddle coupled with and extending from an arm; and (3) spirally slicing the meat product in a direction generally transverse to the first axis.

9 Claims, 5 Drawing Sheets

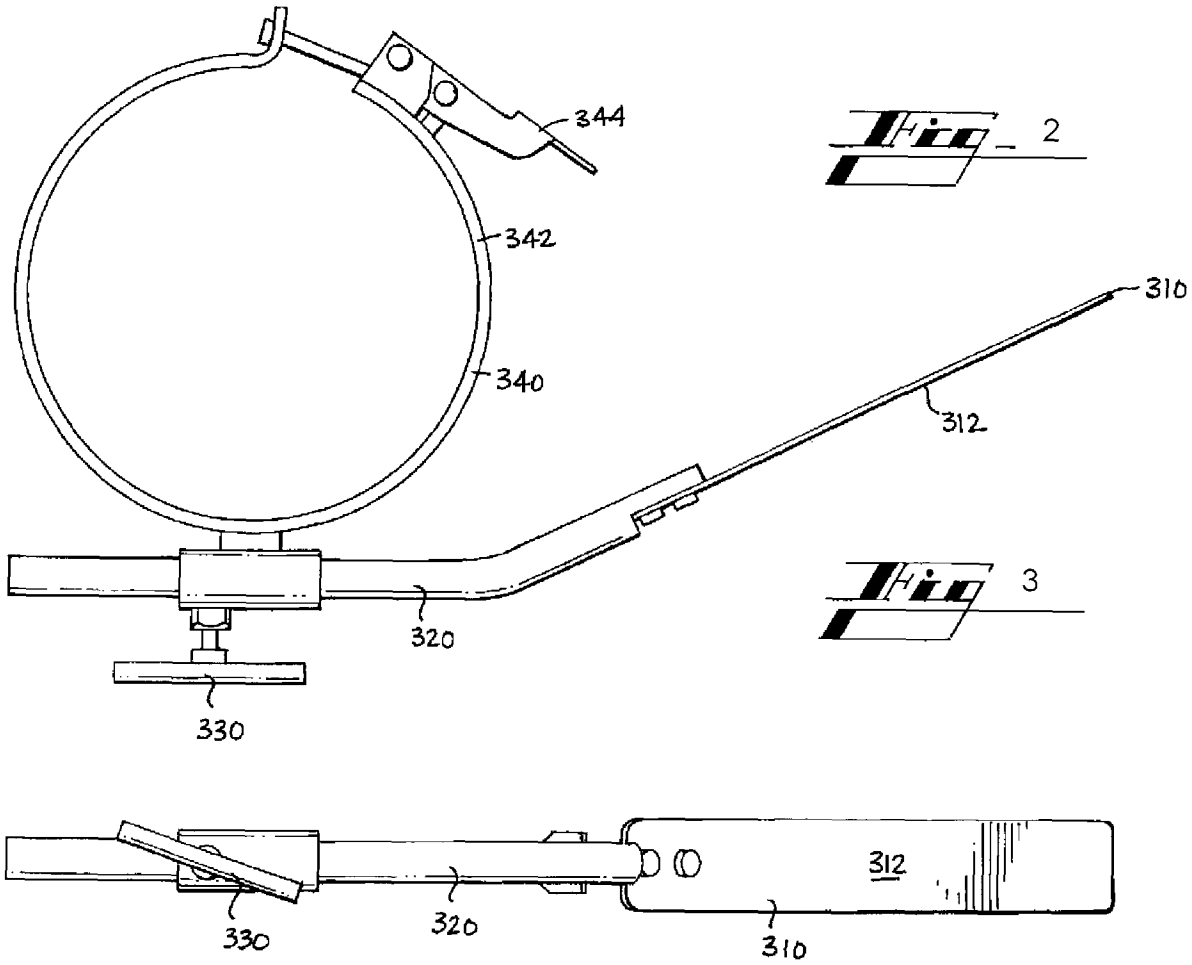
2
3
310
312
344
342
340
320
330
312
310
320
330

122
10

100
120
340
330
320
312
310
110
216
214
200
210
212

APPARATUS AND METHOD FOR SPIRALLY SLICING MEAT

The present invention claims priority to U.S. Provisional Application No. 61/408,323, filed Oct. 29, 2010, the contents of which are incorporated herein by reference in their entirety.

BACKGROUND

1. Field of the Art

The exemplary embodiments relate to an apparatus for handling a product such as meat or cheese during a slicing operation.

2. Description of Related Art

In a conventional spiral meat slicing process, a slab of meat, such as a ham, is placed on a turntable and rotated, while a knife cuts the meat while moving upward, resulting in a spiral or helical cut of meat. In these processes, it can be difficult to stabilize the meat and control the meat slicing quality. For example, the meat may be lifted up by the cutting blade, resulting in non-uniform slices, and/or unsliced portions of meat.

Some attempts have been made to improve the slicing quality of a spiral slicing process. For example, some apparatuses include a top support that puts pressure on the ham from the top. The conventional thinking was that holding down the top, or shank portion, of the ham to keep it from rising when the knife was working its way up the ham. Other attempts to improve the slicing quality include slicing the ham upside down (i.e., butt side up). Yet other attempts of improving the spiral slicing quality are focused on improving the firmness and consistency of the meat product.

The description herein of certain advantages and disadvantages of known methods and devices is not intended to limit the scope of the present invention. Indeed, the present embodiments may include some or all of the features described above without suffering from the same disadvantages.

BRIEF DESCRIPTION OF THE DRAWINGS

Purposes and advantages of the exemplary embodiments will be apparent to those of ordinary skill in the art from the following detailed description in conjunction with the appended drawings in which like reference characters are used to indicate like elements.

FIG. 2 illustrates a meat stabilizing assembly, in accordance with an exemplary embodiment.

FIG. 3 illustrates a meat stabilizing assembly, in accordance with an exemplary embodiment.

These and other exemplary embodiments and advantages will become apparent from the following detailed description, taken in conjunction with the accompanying drawings, illustrating by way of example the principles of the various exemplary embodiments.

DETAILED DESCRIPTION OF PREFERRED EMBODIMENTS

The following description is intended to convey a thorough understanding of the embodiments by providing a number of specific embodiments and details. It is understood, however, that the invention is not limited to these specific embodiments and details, which are exemplary only. It is further understood that one possessing ordinary skill in the art, in light of known devices, systems and methods, would appreciate the use of the invention for its intended purposes and benefits in any number of alternative embodiments.

Generally speaking, the apparatus and method of the exemplary embodiments described herein have a stabilizing apparatus that stabilizes a product, such as meat or cheese, while it is being spirally sliced. The stabilizing apparatus has a paddle that contacts and supports the outer surface of the meat while it is rotating. The paddle may be coupled with a knife carriage of the spiral slicing apparatus. The stabilizing apparatus applies a constant, yet mild, level of pressure onto the face of a product directly above the knife contact point. This pressure holds down the product to prevent the unsliced portion of the product from being lifted up by the knife blade, which may result in non-uniform and unsliced portions of the product. The stabilizing force exerted by the stabilizing apparatus may be compared to that exerted on a loaf of bread during slicing, when an operator holds down the loaf with one hand and moves the knife with the other. While exemplary embodiments are described and shown herein with respect to slicing a meat product, it will be understood that the embodiments may be used or adapted for use in slicing other products, as necessary or desired. As used herein, "meat product" refers to any processed or fresh meats, and boneless or bone-in meats. An exemplary meat product is ham.

Any spiral meat slicing apparatus known in the art, or later developed may be used in the exemplary embodiments. An exemplary spiral meat slicing apparatus is a spiral meat slicing apparatus manufactured by Midwest Metalcraft (Windsor, Mo.), including, for example, model numbers HS-1, HS-2, SHS-1, SHS-4, and SHS-6; or a Spiromatic meat slicing apparatus. While the exemplary embodiments are described and shown herein with a particular type of spiral meat slicing apparatus, one having ordinary skill in the art, having read this disclosure, would understand how to apply the embodiments to other types of spiral meat slicing apparatuses, as necessary or desired.

Figure 4:
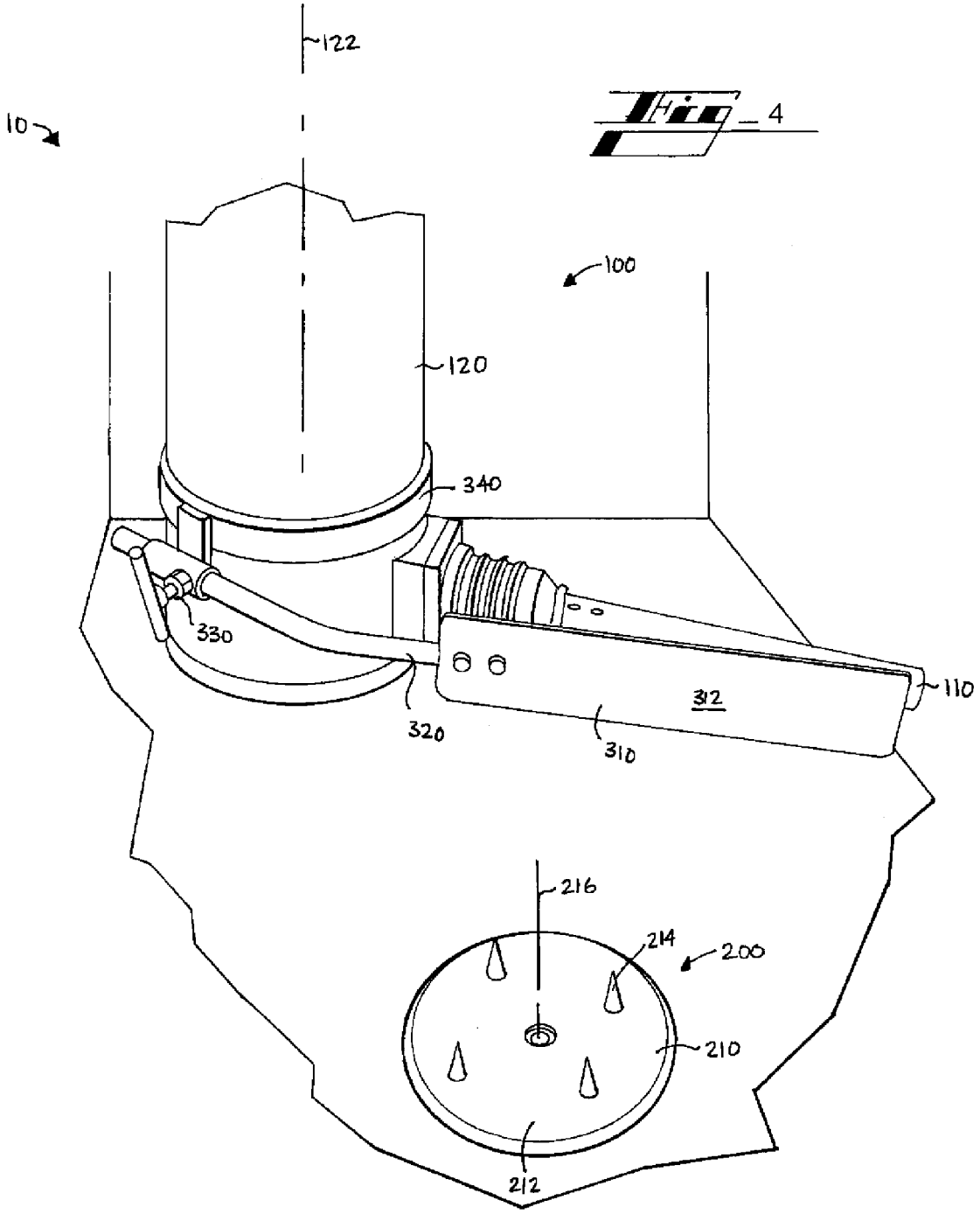
FIG. 4 illustrates a spiral slicing assembly, in accordance with an exemplary embodiment.
Figure 5:
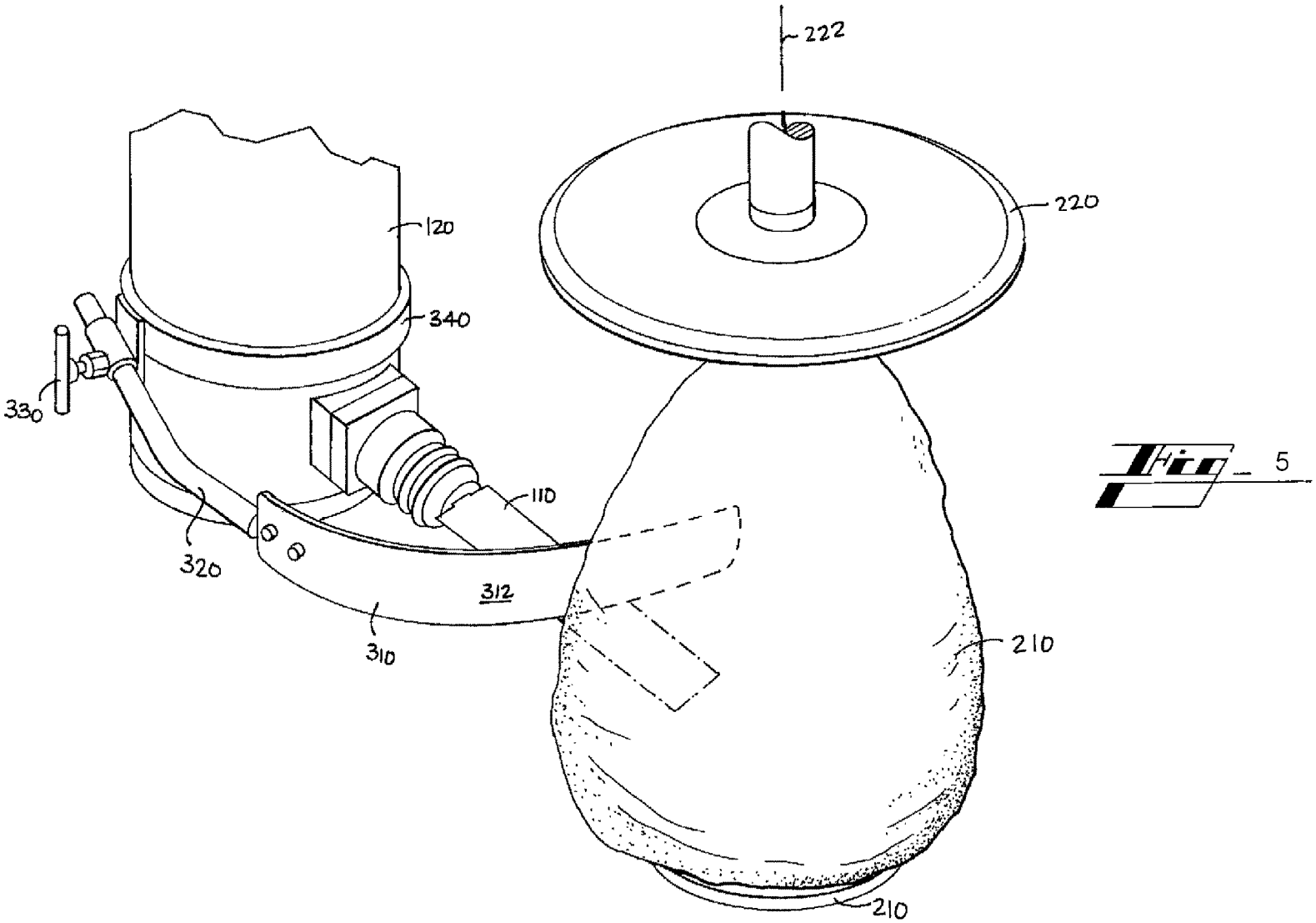
FIG. 5 illustrates a spiral slicing assembly, in accordance with an exemplary embodiment.
Figure 6:
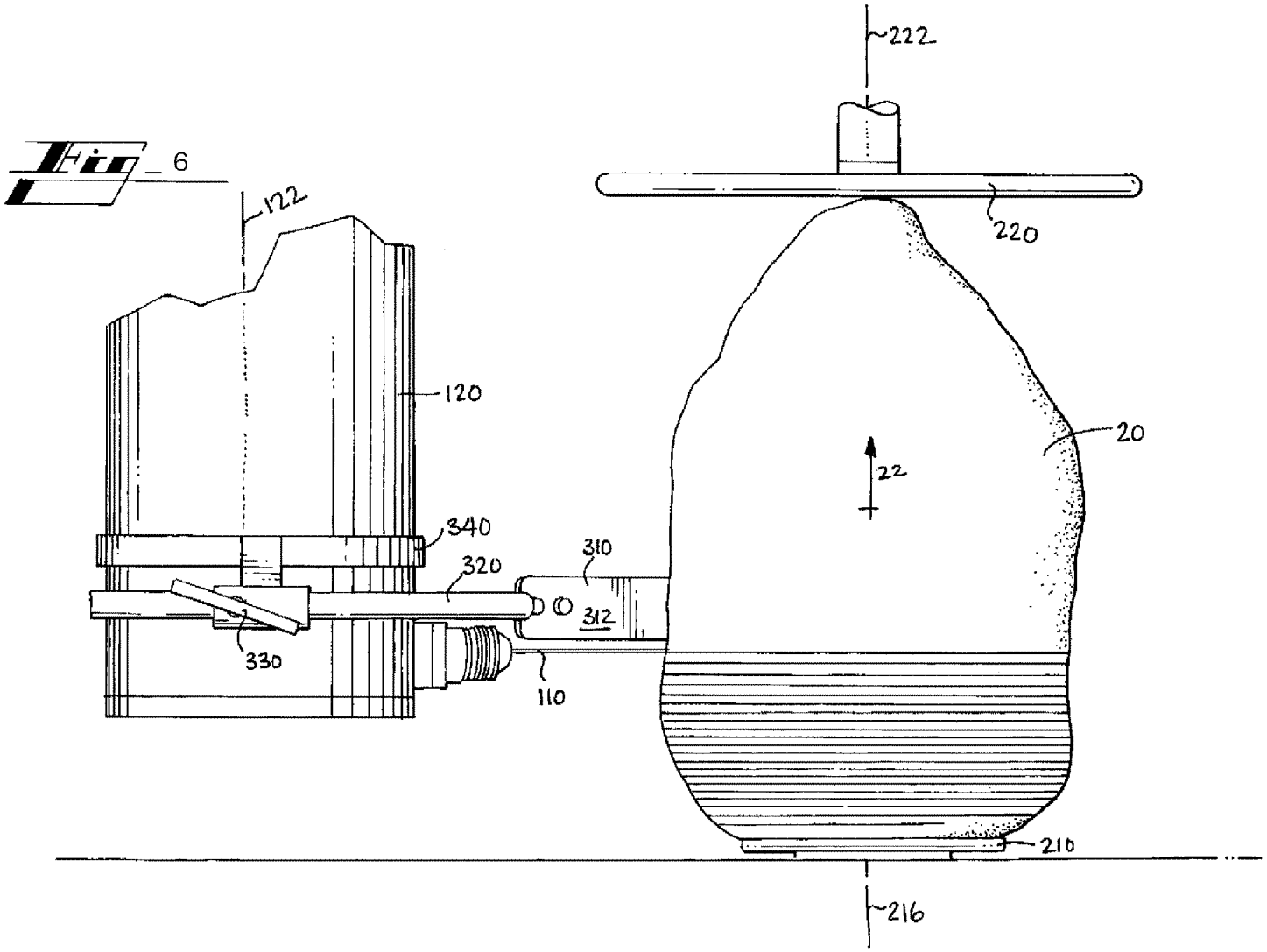
FIG. 6 illustrates a spiral slicing assembly, in accordance with an exemplary embodiment.

Referring to FIGS. 4-6, an exemplary spiral meat slicing apparatus 10 may have a cutting assembly 100 and a meat support assembly 200 that holds and rotates a meat product 20 that is to be spirally sliced in the meat slicing apparatus 10. The meat product 20 has a longitudinal axis 22 and a transverse direction. In an exemplary embodiment, spiral slicing apparatus 10 slices the meat product 20 so as to provide a substantially continuous spiral (helical) slice of meat product about the longitudinal axis 22. In some embodiments, the longitudinal axis 22 may be generally parallel to a bone in the product; in other exemplary embodiments, the longitudinal axis 22 may be at an angle to a bone (e.g., a "side chuck ham" in which the meat may be skewered and sliced at an angle to the bone). The spiral slicing apparatus 10 may slice any necessary or desired portion of the meat along the longitudinal axis 22; for example, the longitudinal ends of the meat product may be left unsliced. It will be understood that the spiral meat slicing apparatus 10 may be configured to provide any necessary or desired spiral or helical configuration.

In an exemplary embodiment, the meat support assembly 200 may have a turntable 210 on which a first end of meat product 20 is mounted. The turntable 210 may have a planar surface 212 and one or more devices extending therefrom that hold the first end of the meat product 20. For example, the turntable 210 may have one or more skewers 214 that may be inserted into the first end of meat product 20 when it is mounted on the turntable 210. It will be understood that any suitable device may be employed in the exemplary embodiments to mount the meat product 20 to the turntable 210, as necessary or desired.

In exemplary embodiments, the turntable 210 may be configured to rotate about a turntable axis 216 that is substantially parallel with the longitudinal axis 22 of the meat product 20 when it is mounted thereon. The turntable 210 may be coupled with a drive mechanism (not shown) to provide rotational movement to the turntable 210. Any suitable drive mechanism may be used to provide a necessary or desired rotational movement to the turntable 210.

In some embodiments, the meat support assembly 200 may have one or more additional meat support mechanisms to further support the meat product 20. For example, an upper support 220 may be provided in opposing relation to the turntable 210, configured to engage with a second end of the meat product 20. The upper support 220 may have one more devices that hold the second end of the meat product 20. For example, the upper support 220 may have one or more downward extending skewers (not shown) that may be inserted into the second end of the meat product 20. The upper support 220 may freely rotate about an axis 222 that is coaxial with the turntable axis 216, and may be driven or undriven, as necessary or desired.

In an exemplary embodiment, the cutting assembly 100 may have a knife carriage 120 that is coupled with a blade 110 for cutting the meat product 20. Any suitable blade 110 may be used in the exemplary embodiments. For example, the blade 110 may be a rotary disc blade, or a reciprocating blade. The knife carriage 120 may extend generally along a longitudinal axis 122 that is substantially parallel with the turntable axis 216. The blade 110 may extend in a direction generally transverse to the longitudinal axis 122 of the knife carriage 120, so that it provides a cut in a generally transverse direction of the turntable 210 (and meat product 20). In exemplary embodiments, the knife blade 110 may move in and out of the meat product, such as by using a pneumatic controller, so that it can cut from the outer surface toward the longitudinal axis 22 of the meat. In some exemplary embodiments, the knife carriage 120 may be configured to rotate about its longitudinal axis 122, so as to swing the blade 110 toward and away from the turntable 210. In some exemplary embodiments, the knife carriage 120 may be configured to move axially along its longitudinal axis 122, so that the blade 110 traverses the longitudinal axis 122.

In an exemplary embodiment, the cutting assembly 100 and meat support assembly 200 work together to provide a spirally sliced meat product 20. For example, the meat product 20 may be mounted to the turntable 210 and upper support 220 so that the longitudinal axis 22 of the meat product 20 is generally aligned with the rotational axis 216 of the turntable 210. A drive mechanism (not shown) then rotates the turntable 210 and the meat product 20 about the turntable axis 216. The knife blade 110 is moved toward the rotating meat product 20, and pierces the outer surface of the meat product 20, slicing the meat in a direction that is generally transverse to the longitudinal axis 22 of the meat product 20. The knife carriage 120 moves longitudinally (about its longitudinal axis 122), carrying with it the blade 110, so that the blade makes a spiral (helical) cut about the longitudinal axis 22 of the meat product 20.

In various exemplary embodiments, the spiral slicing apparatus 10 may have a meat stabilizing apparatus 300 that stabilizes the meat product 20 during the spiral slicing operation. Referring to FIGS. 4-6, generally speaking, the meat stabilizing apparatus 300 has a paddle 310 or a roller (not shown) that has a surface that tangentially contacts the outer surface of meat product 20 adjacent the knife blade 110 as the meat product 20 rotates on the turntable 210. In an exemplary embodiment, the paddle 310 provides a stabilizing force to the rotating meat product 20. The stabilizing force may be compared to that exerted on a loaf of bread during slicing, when an operator holds down the loaf with one hand and moves the knife with the other. This stabilizing force helps to stabilize the meat product 20, to provide a more consistent spiral slice, thereby improving process quality and reducing process waste.

Figure 1:
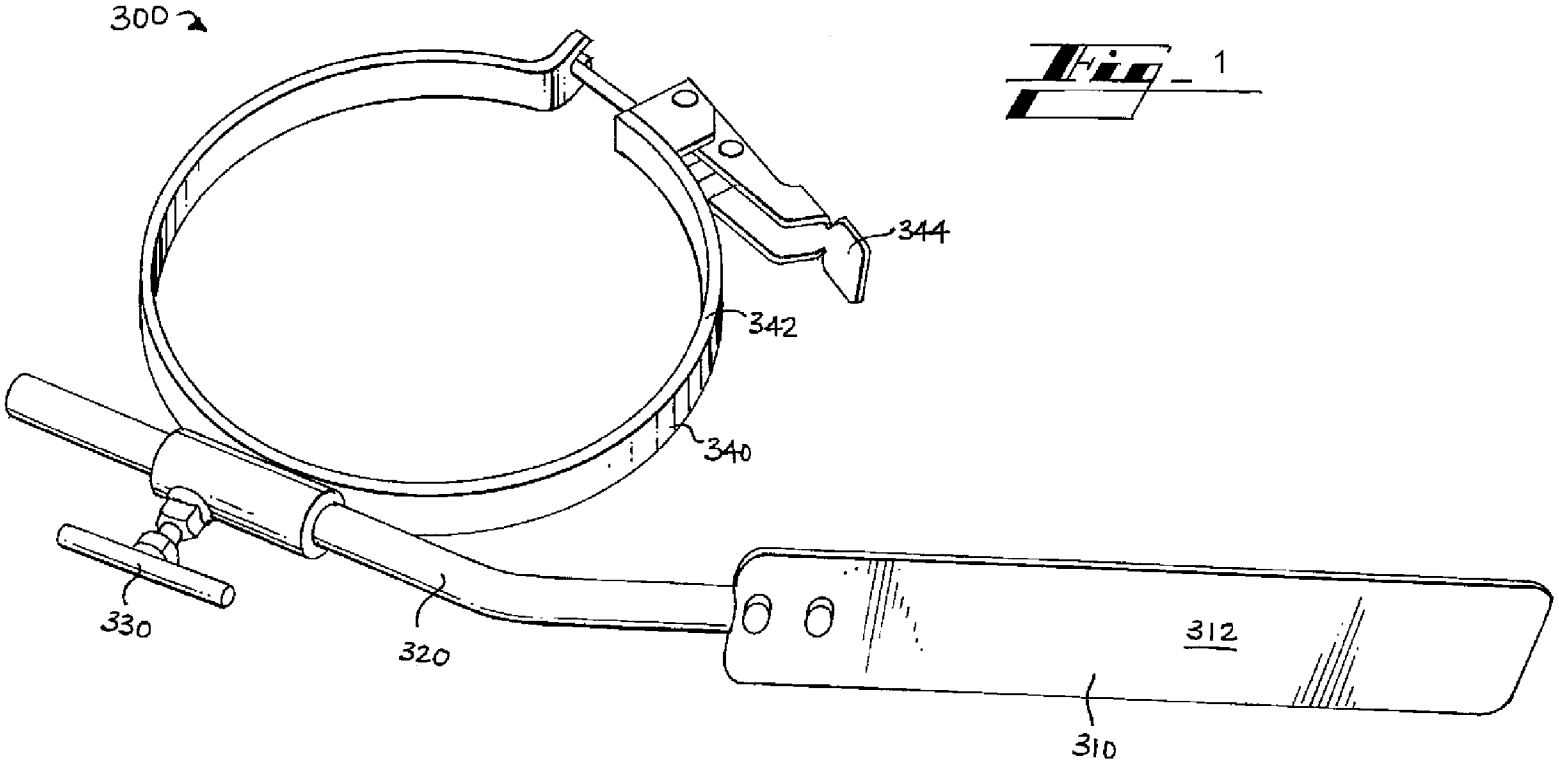
FIG. 1 illustrates a meat stabilizing assembly, in accordance with an exemplary embodiment.

Referring to FIGS. 1-3, the meat stabilizer paddle 310 is a substantially planar device, having two opposed surfaces, including a meat contacting surface 312 that is configured to contact the outer surface of the meat product 20 as it rotates about turntable 210. The meat contacting surface 312 preferably has a relatively low coefficient of friction so that the meat product 20 may freely rotate against the meat contacting surface 312 when the two are in contact. In exemplary embodiments, the meat contacting surface 312 of paddle 310 may be elongated, having a length dimension (extending generally in the transverse direction of the meat product) that is significantly larger than a width dimension (extending generally in the longitudinal direction of the meat product). In an exemplary embodiment, the paddle 310 has a length dimension that is approximately 13-15 inches, and a width dimension that is approximately 2-4 inches.

In exemplary embodiments, the paddle 310 is configured so that the meat contacting surface 312 is generally parallel to the turntable axis 216 (and the longitudinal axis of the meat product 20). In exemplary embodiments, the paddle 310 may have a vertical pitch, or the top or bottom edge of the paddle 310 may be angled toward or away from the meat product 20, as necessary or desired.

In exemplary embodiments, the paddle 310 is located adjacent the knife blade 110. For example, the paddle 310 may be disposed directly above the plane of the knife blade 110 (i.e., ahead of the cutting plane, if the apparatus is oriented in a different direction). In an exemplary embodiment, the bottom edge of the paddle 310 is at least about 0.25 inches above the knife blade 110. The distance between the paddle 310 and the knife blade 110 may be increased or decreased as necessary or desired. In exemplary embodiments, the longitudinal direction of the paddle 310 is parallel to the longitudinal direction of the knife blade 110. In exemplary embodiments, the paddle 310 is spaced from the knife blade 110 so that it does not restrict the knife's contact with the meat product 20.

In exemplary embodiments, the paddle 310 preferably is constructed of a material that is flexible, but capable of providing sufficient stabilizing force to a meat product 20. In addition, the material should be safe and suitable for processing food. An exemplary material is spring steel, or plastic or composite. Any suitable material can be used as necessary or desired. As shown in FIG. 5, the paddle 310 may be flexed in a first direction when the paddle 310 contacts the rotating meat product 20. In some exemplary embodiments, the paddle 310 flexes backward over the knife blade 110, so that the paddle 310 provides a stabilizing force directly above the knife blade 110.

In exemplary embodiments, the meat stabilizer apparatus 300 is coupled with cutting assembly 100. In a preferred exemplary embodiment, the meat stabilizing apparatus 300 is fixedly coupled with the knife carriage 120 so that the paddle 310 is positioned at a constant longitudinal distance from the knife blade 110, and it moves in a longitudinal direction with the knife blade 110. In some embodiments, the meat stabilizer apparatus 300 may be integral with the cutting assembly 100. Referring to FIGS. 1-3, in exemplary embodiments, the stabilizer apparatus 300 may have a cutting attachment mechanism 340 that is configured to attach the stabilizer apparatus 300 to the cutting assembly 100. Where the cutting assembly 100 has a cylindrical knife carriage 120, the attachment mechanism 340 may have, for example, a collar portion 342 that encircles the carriage 120, and a clamp portion 344 that fastens the collar portion 342 about the carriage 120. It will be understood that the attachment mechanism 340 may employ various additional or alternative attachment devices, as necessary or desired.

In exemplary embodiments, the paddle 310 is coupled with the cutting attachment mechanism 340, so that it extends generally transverse to the longitudinal axis 122 of the knife carriage 120. For example, the paddle 310 may extend in a plane that intersects the longitudinal axis 122, or it may extend in a plane that is orthogonal to, but does not intersect the longitudinal axis 122. Referring to FIGS. 1-3, in an exemplary embodiment, the paddle 310 may be attached to an arm 320 that is tangentially coupled with the collar 342 at arm attachment mechanism 330. Any suitable arm attachment mechanism 330 could be used to fixedly or removably couple the arm 320 to the attachment mechanism 340. For example, the arm 320 could be inserted into a sleeve or a lug, wherein a threaded fastener secures the arm 320 in place. The arm 320 may be extended or retracted, for example, to adjust for larger or smaller meat products.

In an exemplary embodiment, the arm 320 is bent at an intermediate position. The bend in the arm 320 is configured to position the paddle 310 at a necessary or desired angle relative to the knife blade 110, the turntable 210, and/or the meat product 20. In an exemplary embodiment, the paddle 310 (in its un-flexed configuration) is parallel to the longitudinal direction of the knife blade 100. This angle may be configured to provide a necessary or desired function.

In exemplary embodiments, the meat stabilizer apparatus 300 improves the uniformity of the meat slice thickness. By effectively holding down the meat product 20 as it is sliced, the meat stabilizing apparatus 300 effectively "captures" the meat product 20 at the point of slicing.

In exemplary embodiments, the meat slicing apparatus 300 may be configured to work with the varying topography of the meat product 20. Because each meat product 20 has a different shape, in preferred exemplary embodiments, the meat slicing apparatus 300 may conform to the shape of the meat to maintain effective contact during the slicing operation. For example, one may vary the following variables as necessary or desired: the stiffness or flexibility of the paddle; the angle and orientation of the paddle 310 to the meat, etc.

In exemplary embodiments, a method of spirally slicing meat includes rotating a meat product 20 on a turntable 210. The meat product 20 may have a longitudinal axis 22 that is generally aligned with the rotational axis of rotation of the turntable 210. The meat product may be secured to the turntable 210, such as inserting one or more skewers 214 into the meat product 20. A rotatable upper support 220 may be provided to further support the meat product 20 on the turntable 210.

In an exemplary method, the rotating meat product 20 may be stabilized along its exterior surface with a meat stabilizer apparatus. An exemplary meat stabilizing apparatus includes a paddle 310 that is configured to contact the exterior surface of the meat product 20 and provide a stabilizing force to the rotating meat product.

An exemplary method further includes the step of spirally slicing the meat product 20. The knife blade 110 makes a cut in a direction generally transverse to the longitudinal axis of the meat product 20, while the knife blade 110 moves continuously in a longitudinal direction relative to the meat product 20, causing a spiral or helical meat slicing pattern. In an exemplary embodiment, the step of stabilizing the meat product 20 and slicing the meat product 20 may be conducted simultaneously. In an exemplary method, the sliced meat product 20 may be provided as a unit, or may be processed further. For example, the sliced meat product 20 may be cut in half or into other portions.

EXAMPLE

A meat stabilizing apparatus was made having the following specifications:

ID of collar 7 15/16"
Collar material: ¼"×1" 316 SS
Holding Arm: ¾" dia 316 SS
Paddle: 10⅞"×3"×0.022" (24 gauge) 321 SS spring steel
Clamp: McMaster Can 11605A14 MODIFIED Work Load Rated Exposed Adjustable Draw Latch: 304 SS, 200 # capacity The meat stabilizing apparatus was mounted on the mast of a MMC (Midwest Metalcraft, Windsor, Mo.) spiral slicing unit with the collar and clamping device. The paddle arm was inserted in a mounting lug and a T-handle adjustment screw secured the arm within the lug. When mounted, the bottom of the paddle is approximately ¼" above the slicing knife.

A ham was inserted in the spiral slicing unit with the butt-end of the ham placed on the turntable. The ham was sliced using the meat stabilizing apparatus. Test runs showed an improvement of 6% for the thick-thin slicing defect rate. Test runs also showed a significant decrease in "missing pieces," because the apparatus held together the ham pieces during the slicing process so that the ham could be sliced without falling apart. Such an improvement in defect rate can result in significant cost savings for a spiral slicing process.

In the preceding specification, various preferred exemplary embodiments have been described with reference to the accompanying drawings. It will, however, be evident that various modifications and changes may be made thereto, and additional exemplary embodiments may be implemented, without departing from the broader scope of the invention as set forth in the claims that follow. The specification and drawings are accordingly to be regarded in an illustrative rather than restrictive sense.

What is claimed is:

1. A spiral slicing apparatus for cutting a product having an outer surface, the apparatus comprising:

a meat support apparatus having a turntable rotatable about a longitudinal axis;

a cutting assembly having a knife blade configured transverse to the longitudinal axis of the rotatable turntable coupled with a knife carriage; and a meat stabilizer apparatus having a paddle constructed of a flexible material and an arm attached to and extending from the paddle, wherein the paddle is configured to move toward or away from a longitudinal axis of the product disproportionally to movement of the knife blade, wherein the paddle has a product contact surface which tangentially contacts the outer surface of the product, and freely slides past the outer surface of the product while the product is rotating, and wherein the configuration of the apparatus places the paddle adjacent to the knife blade on the same side of the product.

2. The apparatus of claim 1, wherein the meat stabilizer apparatus further comprises a cutting attachment mechanism for coupling the paddle and arm to the knife carriage associated with the cutting assembly.

3. The apparatus of claim 1, wherein the paddle is positioned above or below the knife blade with respect to the longitudinal axis of the product.

4. The apparatus of claim 1, wherein the knife carriage is configured to cause the knife blade to move in and out of the product irrespective of movement of the paddle.

5. The apparatus of claim 1, wherein the product is a meat or cheese product.

6. The apparatus of claim 1, wherein the meat stabilizer apparatus is moveable in an upward or downward direction parallel to the longitudinal axis of the product, so as to increase or decrease a distance between the paddle and the knife blade.

7. The apparatus of claim 1, wherein the flexible material is spring steel, plastic, or composite material.

8. The apparatus of claim 1, wherein the blade is a rotary disc blade.

9. The apparatus of claim 1, wherein the blade is a reciprocating blade.

* * * * *